United States Patent [19]

Johnson et al.

[11] Patent Number: 4,522,558

[45] Date of Patent: Jun. 11, 1985

[54] BLOWER WHEEL APPARATUS

[75] Inventors: Edward J. Johnson, Tempe; Robert L. Koble, Jr., Phoenix, both of Ariz.

[73] Assignee: Phoenix Manufacturing, Inc., Phoenix, Ariz.

[21] Appl. No.: 567,678

[22] Filed: Jan. 3, 1984

[51] Int. Cl.[3] ..... F04D 29/28

[52] U.S. Cl. ..... 416/187; 29/156.8 CF; 415/206; 416/135; 416/178

[58] Field of Search ..... 416/204, 187, 178, 135, 416/142, 205, 199; 415/206; 29/156.8 CF

[56] References Cited

U.S. PATENT DOCUMENTS 3,080,105 3/1963 Merz ..... 29/156.8 CF 3,811,978 5/1974 Wooden ..... 416/187 X

FOREIGN PATENT DOCUMENTS 114897 9/1980 Japan ..... 416/178

*Primary Examiner*—Everette A. Powell, Jr.

*Attorney, Agent, or Firm*—H. Gordon Shields

[57] ABSTRACT

Blower wheel apparatus for squirrel cage type blowers includes flexible hubs with integral collars for fastening the blower wheel onto a rotating shaft so that the hubs and collars may be moved inwardly for inserting the blower wheel into a housing and then moved outwardly for securing the blower wheel onto the shaft after the blower wheel and shaft are disposed in the blower housing.

16 Claims, 8 Drawing Figures

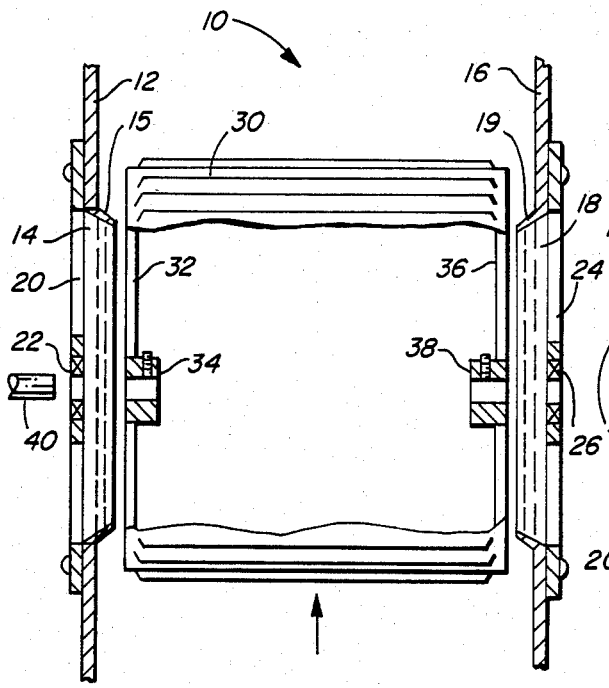
FIG. 1A
(PRIOR ART)
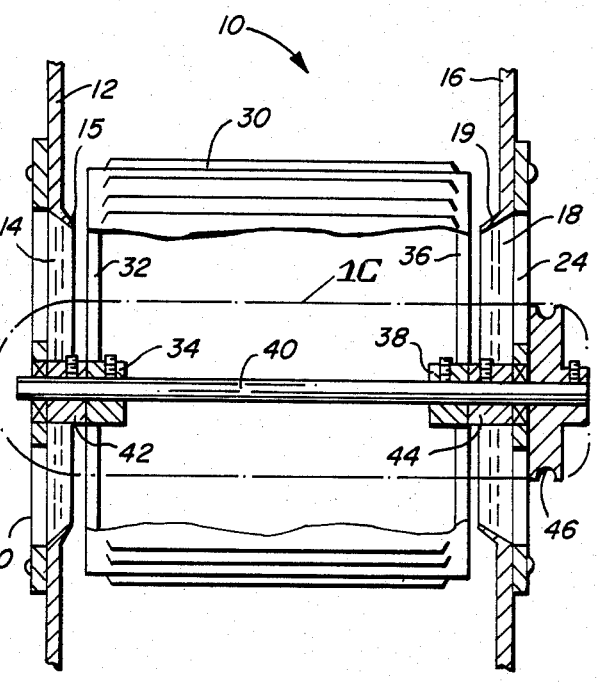
FIG. 1B
(PRIOR ART)
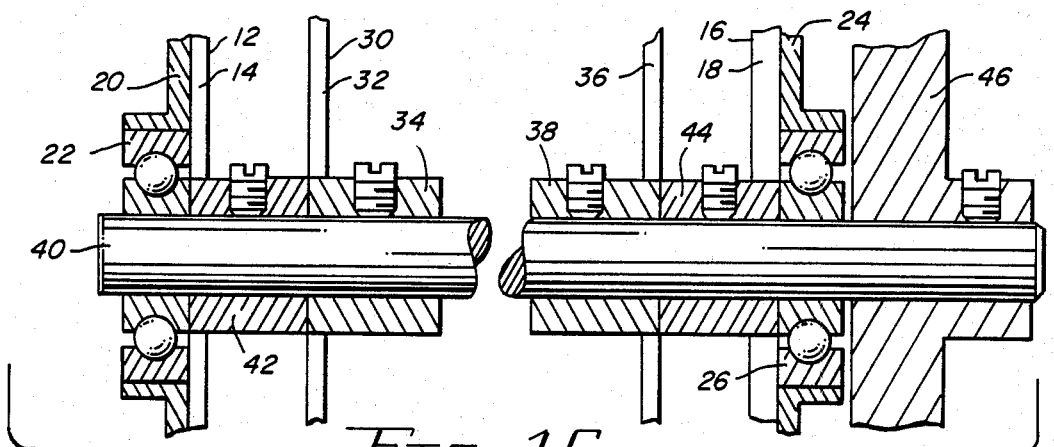
FIG. 1C
FIG. 2
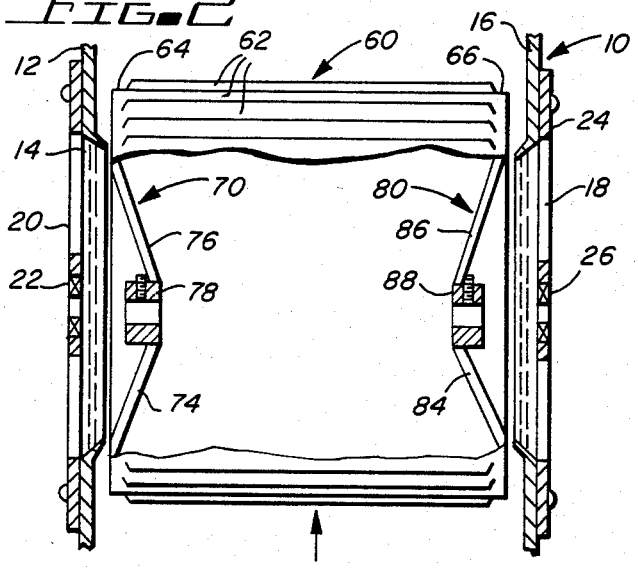
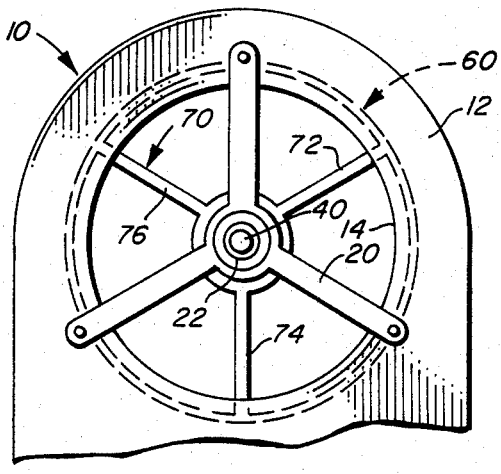
FIG. 3

BLOWER WHEEL APPARATUS

BACKGROUND OF THE INVENTION

1. Field of the Invention

This invention relates to blower wheels and, more particularly, to blower wheels disposed within blower housings and commonly referred to as squirrel cage blowers, such as typically utilized in evaporative cooling systems.

2. Description of the Prior Art

Squirrel cage type blowers utilize a blower wheel disposed within a blower housing. The diameter of the blower wheel is slightly greater than the diameter of the air intake openings in the blower housing. The blower wheel is assembled within the housing by inserting the blower wheel into the housing from the mouth or discharge air opening of the blower wheel housing. The blower wheel is supported on a rotatable shaft which is inserted through the blower wheel after the wheel is disposed in the housing. The shaft is in turn secured to the blower wheel through a hub assembly. The shaft and blower wheel are in turn secured to a spider assembly of the housing.

The spider assembly of the housing includes bearings which support the rotatable shaft and which allow the shaft and the blower wheel to rotate. The bearings are usually flush with the outside of the housing and extend outwardly therefrom. Since the blower wheel is disposed within the housing, there is of necessity a space between the hub assembly of the blower wheel and the bearing assembly at the hub of the housing spider. This space is taken up by spacers. In most assemblies, there are two spacers, one at either end of the blower wheel, to position the blower wheel between the bearing assemblies of the housing spider so as to prevent lateral movement of the blower wheel. The hub portion of the blower wheel spider assembly usually extends inwardly from the spider assembly, and the spacer then is disposed between the exterior of the hub assembly and the housing spider.

The requirement of the spacers adds both to the expense or cost of the blower wheel and housing assembly and to the time required to the assembly process since both hubs need to be secured to the shaft and both collars need to be secured to the shaft.

SUMMARY OF THE INVENTION

The invention described and claimed herein comprises a blower wheel and housing assembly which eliminates the spacers and places the collars on the exterior of the wheel hub assembly of a blower wheel spider for direct placement against the bearing assemblies of a blower housing spider. The spider assembly of the blower wheel is flexible so that the spider is bent or deformed inwardly while the blower wheel is assembled into the blower housing. The blower wheel spider assembly, after assembly into the housing, is moved or deformed outwardly to place the collar of the hub assembly against the bearing assembly of the blower housing spider.

Among the objects of the present invention are the following:

To provide new and useful blower apparatus;

To provide new and useful blower wheel apparatus;

To provide new and useful blower wheel apparatus utilizing collars disposed against the bearing assemblies of a blower housing; and To provide new and useful blower apparatus to position a blower wheel in a blower wheel housing without spacers.

BRIEF DESCRIPTION OF THE DRAWING

FIGS. 1A and 1B are views in partial section illustrating the assembly of the prior art apparatus.

FIG 1C is an enlarged view in partial section of the prior art apparatus of FIG. 1B, taken generally from the dashed enclosure 1C of FIG. 1B.

FIG. 2 is a view in partial section of the apparatus of the present invention.

FIG. 3 is a side view of the apparatus of FIG. 2.

DESCRIPTION OF THE PREFERRED EMBODIMENT

Figure 4:
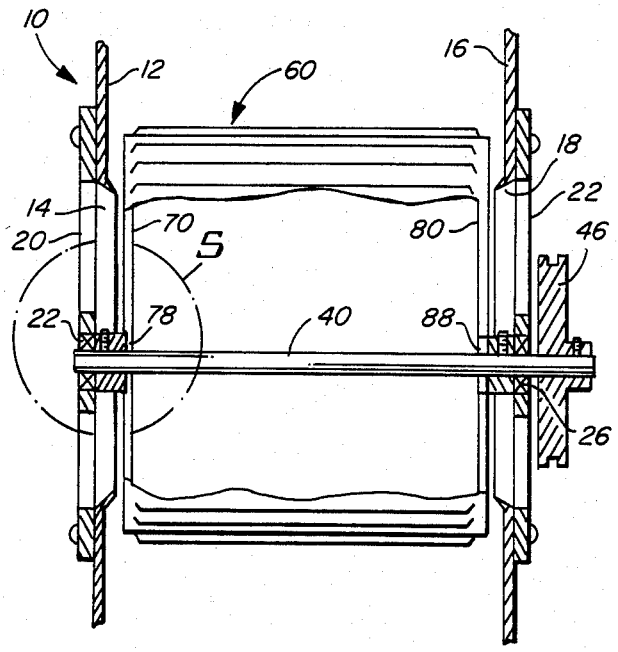
FIG. 4 is a view in partial section illustrating the assembly of the apparatus of the present invention.

FIGS. 1A and 1B are views in partial section of a blower housing 10 showing sequentially the insertion of a blower wheel 30 of the prior art into the blower housing. FIG. 1A shows the blower wheel 30 inserted into the housing 10. FIG. 1B shows the blower wheel 30 secured within the blower housing 10. FIG. 1C is an enlarged view in partial section of a portion of the blower wheel housing 10 and the blower wheel 30, taken generally from the dashed line 1C in FIG. 1B. For the following discussion of the prior art, reference will primarily be made to FIGS. 1A, 1B, and 1C.

The blower housing 10 includes two sides, a side 12 and a side 16. Each side includes an aperture or opening therein. Side 12 includes an aperture or opening 14, and the side 16 includes an aperture or opening 18. The apertures 14 and 18 comprise air intake openings through which air flows into the blower housing 10 as the blower wheel 30 within the housing rotates. The openings 14 and 16 include inwardly rolled rims 15 and 19, respectively.

For securing the blower wheel 30 to the housing 10, there is a spider assembly 20 secured to the side 12 adjacent to the opening 14. There is also a spider assembly 24 secured to the side 16 and adjacent to the opening 18. As shown in FIG. 1A, the blower 30 is aligned with the spider assemblies 20 and 24. The spider assemblies 20 and 24 include central hubs having bearings 22 and 26, respectively, which support a shaft 40.

The blower wheel 30 includes a pair of side rims 32 and 36. The rims include integral spider assemblies which extend inwardly and which terminate in a pair of hubs or collars. The rim 32 includes a collar 34, and the rim 36 includes a collar 38. The shaft 40 extends through the bearings 22 and 26 of the spider assemblies 20 and 24, respectively, of the blower housing 12 and through the hubs 34 and 38 of the blower wheel 30.

FIG. 1B shows the shaft 40 extending through and locked to the hub assemblies 34 and 38 of the blower wheel rims 32 and 36, respectively, and through the aligned spider assemblies 20 and 22 of the blower housing 10. A pulley 46 is shown secured to one end of the shaft 40. The pulley or pulley wheel 46 is used to couple the shaft 40 and the blower wheel 30 to an electrical motor of an appropriate belt, not shown.

As is evident from the FIGS. 1A and 1B, the diameter of the blower wheel 30 is greater than the diameter of the openings 14 and 18 in the sides 12 and 16, respectively, of the housing 10. Accordingly, the blower wheel 30 is inserted upwardly into the housing from its bottom or mouth. This is schematically illustrated in FIG. 1A by the arrow shown beneath the blower wheel 30.

Since the spider assemblies 20 and 22 are disposed on the outside of the sides 12 and 16, respectively, of the blower housing 10, there is a space between the outside of the collars 34 and 38 of the blower wheel 30 and the aligned hubs of the spider assemblies 20 and 22. This is shown in FIG. 1A. The space between the hubs of the blower wheel 30 and the blower housing spider assemblies is shown in FIGS. 1B and 1C as being taken up by a pair of spacers 42 and 44. The spacer 42 is disposed between the hub or collar 34 of the blower wheel 30 and the bearing 22 of the spider assembly 20. The spacer 44 is shown disposed between the blower wheel hub or collar 38 and the bearing assembly 26 of the spider assembly 24. As best shown in FIG. 1C, set screws are used to secure the spacers to the shaft 40 and also to secure the blower wheel collars or hubs to the shaft 40. The use of the spacers 42 and 44 is required to prevent the blower wheel 30 from moving within the housing 10.

As also shown in FIG. 1C, the pulley 46 is secured to the shaft 40 by means of a set screw.

As shown in FIGS. 1A, 1B, and particularly in FIG. 1C, the blower wheel hubs or collars 34 and 38 extend inwardly from the supporting arms or spider assemblies of the blower wheel rims 32 and 36. They accordingly are inwardly facing towards each other. The spacers 42 and 44 are disposed against the outer portions of the hubs or collars 34 and 38, and thus they occupy the space between the spider assembly of each side of the blower wheel housing and the collars of the blower wheel itself.

FIG. 1C, which is an enlarged view in partial section, shows the relationship between the spider assemblies 20 and 24, and their respective bearings 22 and 26, of the blower housing 10, and the shaft 40 and the blower wheel 30 disposed in the housing 10. In particular, it will be noted that the center hubs or collars 34 and 38 of the blower wheel 30 extend inwardly, or towards the inside of the wheel 30. With the hubs or collars 34 and 38 extending inwardly, into the interior or center of the blower wheel 30, the spacers 42 and 44 occupy the space on the shaft 40 outwardly from the collars, and between the collars and the bearing assemblies 22 and 26, of the spider assemblies 20 and 24, respectively, of the blower housing 10.

It is also shown in FIG. 1C that the spacers 42 and 44 extend from the outer portions of the blower wheel 30, that is, outwardly from the collars 34 and 38, through the openings 14 and 18 in the blower sides 12 and 16, respectively. The gap or space bridged by the spacers 42 and 44 includes the distance from the sides of the blower 30 to the blower housing 10, and through the openings 14 and 18 in the blower wheel housing sides 12 and 16, respectively, to the bearing assemblies 22 and 26. As is shown, the bearing assemblies 22 and 26 are supported by the support structure or spider assemblies 20 and 24, respectively, which are in turn secured to the outer portions of the sides 12 and 16 of the blower housing 10. This is shown best in FIGS. 1A and 1B.

Figure 5:
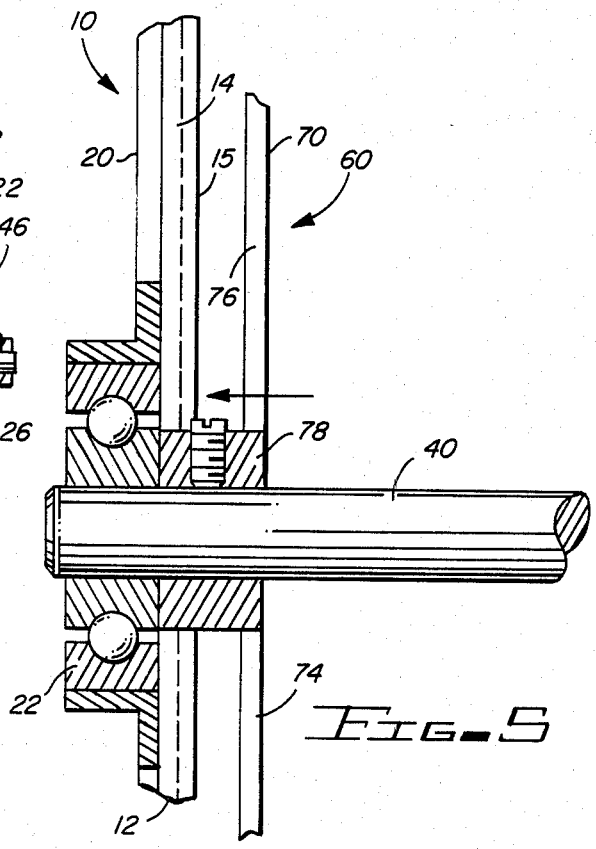
FIG. 5 is an enlarged view in partial section of the apparatus of FIG. 4, taken generally from circle 5 of FIG. 4.

The apparatus of the present invention is shown in FIGS. 2, 3, 4, and 5. FIG. 2 is a view in partial section of the blower housing 10, discussed above in conjunction with FIGS. 1A, 1B, and 1C, with a blower wheel 60 of the present invention disposed therein. FIG. 3 is a side view of the blower housing 10, showing the blower wheel 60 disposed therein, and also showing the spider assembly 20 secured to the side 12 of the housing 10. FIG. 4 is a view in partial section of the housing 10 with the blower wheel 60 disposed therein and assembled to the shaft 40. FIG. 5 is an enlarged view in partial section of a portion of the blower wheel 60 and the housing 10 taken generally from circle 5 of FIG. 4. For the following discussion, reference will primarily be made to FIGS. 2, 3, 4, and 5.

A blower wheel 60 of the present invention is shown in FIG. 2 disposed within the blower housing 10. As discussed above, the blower wheel 60 is also inserted into the blower housing 10 from below, through the bottom or mouth of the housing. This is illustrated in FIG. 2 by the arrow disposed beneath the blower wheel 10.

The blower wheel 60 includes a plurality of blades 62 secured to and extending between a pair of circular rims 64 and 66. A pair of spider support assemblies 70 and 80 extend radially inwardly from the rims 64 and 66, respectively. The spiders 70 and 80 include a plurality of inwardly extending spokes or arms which terminate inwardly at a pair of hubs or collars 78 and 88, respectively. The spider or support assembly 70 includes inwardly extending arms 72, 74, and 76. The arms 72, 74, and 76 extend radially inwardly from the rim 64 to the collar 78. The support assembly or spider 80 includes three radially extending arms, two of which, arms 84 and 86, are shown in FIG. 2. The three arms extend radially inwardly from the rim 66 to the collar 88.

As illustrated in FIG. 2 and in FIGS. 4 and 5, the hubs or collars 78 and 88 extend outwardly, or are on the outside of the spider assemblies 70 and 80, respectively. This is different from the prior art shown in FIGS. 1A, 1B, and 1C.

In order to accommodate the extra width of the wheel due to the external or outside disposition of the hubs or collars 78 and 88, the spiders 70 and 80 are shown in FIG. 2 as bending or flexing inwardly toward the center of the blower wheel 60. The arms of the spiders 70 and 80, with the collars 78 and 88, are bent or deflected inwardly for insertion of the wheel 60 into the blower housing 10. When the blower wheel 60 is in position within the housing 10, and aligned with the openings 14 and 18, the hubs or collars 78 and 88 are moved outwardly on the shaft 40 and into position against the bearing assemblies 22 and 26 of the spider assemblies 20 and 24, respectively, of the blower housing 10. This is shown in FIGS. 4 and 5.

It will be noted, as best shown in FIG. 5, that the collars or hubs extend into the openings in the sides of the blower housing 10 and against the bearing assemblies. In the enlarged view of FIG. 5, the collar is shown extending into the opening 14 of the side 12 of the housing 10, and against the bearing assembly 22. The collar or hub 78 is, of course, secured to the shaft 40 by a set screw, as is well known and understood.

The inward deflection of the spider assemblies 70 and 74, and their arms and their hubs or collars 78 and 88, respectively, is shown in FIG. 2. It will be understood that it is necessary for the spiders with their hubs and collars to deflect inwardly during the insertion or assembly of the blower wheel 60 into the housing 10. It will be understood, from reference to FIG. 5, which shows the collar or hub 78 extending into the opening 14 of the side 12, that without the inward deflection, the hubs or collars would not be able to fit into the blower housing 10. The overall width of the wheel 60 at the collars or hubs 78 and 88, with the spiders in their normal, undeflected state, is greater than the inside width of the housing 10 between the sides or walls 12 and 16.

With the collars 78 and 86 appropriately secured to the shaft 40, which is inserted through the bearing assemblies 22 and 26 of the spiders 20 and 24, respectively, and through the collars or hubs 78 and 88 of the blower wheel 60, the set screws in the collars 78 and 88 are clamped against the shaft 40 to secure the blower wheel 60 to the shaft. The blower wheel then rotates with the shaft and within the bearing assemblies 22 and 26 of the blower wheel housing 10. As indicated above, rotation of the shaft 40 and of the blower wheel 60 is accomplished through the belt drive between a motor, not shown, and the pulley 46. The pulley 46 is, of course, secured to the shaft 40 also by a set screw, or the like, after the shaft is assembled to the blower wheel.

FIG. 3 is a side view of the blower housing 10, showing the opening 14 in the side 12. The outer diameter or outer configuration of the blower wheel 60 is shown in dotted line. Since the diameter of the blower wheel 60 is greater than the diameter of the opening 14, the blower wheel is inserted into the housing 10 from the bottom or mouth of the housing, as discussed above. The spider assembly 20 is shown secured to the side 12 of the housing 10, and the bearing assembly 22 is shown disposed in or secured to the center or hub of the spider assembly 20. The spider assembly 70 of the blower wheel 60 is also shown, with its three arms 72, 74, and 76 extending from the rim 64 to the hub or collar 78 (see also FIGS. 2, 4, and 5.)

Figure 6:
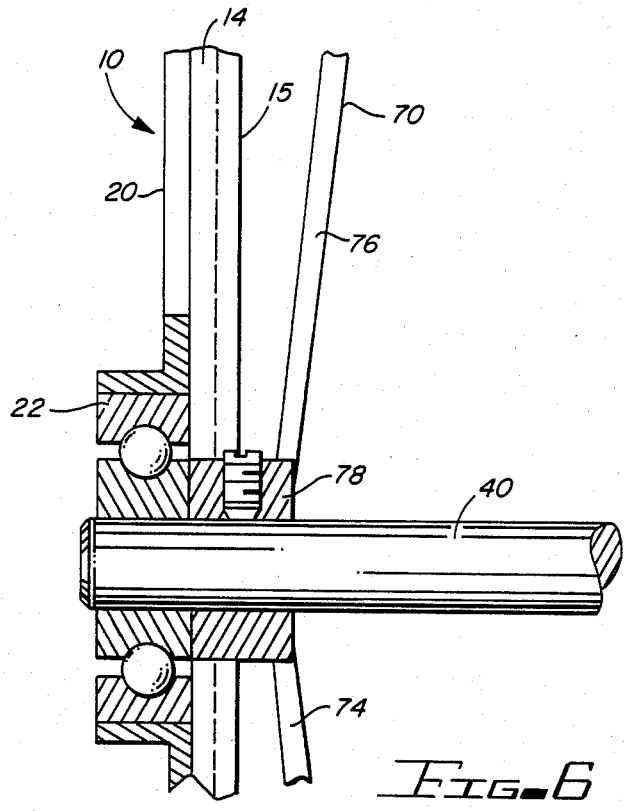
FIG. 6 is an enlarged view in partial section similar to FIG. 5, illustrating a particular adaptation of the apparatus of the present invention.

As will be understood, if necessary, the spider assemblies for the blower wheel may be moved outwardly beyond the plane of the rims of the blower wheel. If or when necessary to take up space between the bearing assemblies of the spiders of the housing, the extra outer deflection of the blower wheel spider may be required. If the normal, flush or planar orientation of the spider assemblies 70 and 80, as shown in FIG. 5, does not take up the entire distance or space between the bearing assemblies, so that the collars or hubs 78 and 88 are not disposed against the bearing assemblies 22 and 26, then the spider assemblies 70 and 80 may be moved or flexed outwardly so that the hubs 78 and 88 will be disposed against the bearing assemblies. This is shown in FIG. 6, which is an enlarged view of a portion of the apparatus of the present invention, similar to FIG. 5, but showing an alternative functioning of the apparatus. The extra outward deflection will take up any extra space or distance to prevent any lateral movement of the blower wheel.

The inherent flexibility of the spider assemblies 70 and 80 of the present invention allows the blower wheel 60 to be inserted into the housing, as discussed above and as best shown in FIG. 2, and also allows for an extra outward flexing or bending of the spider assemblies to allow the collars 78 and 88 to be disposed against the bearing assemblies to prevent any lateral movement of the blower wheel while the blower wheel is running.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principels. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Blower wheel apparatus having a first overall width for installation into a blower housing having a pair of sides spaced apart from each other and a pair of circular openings aligned with each other in the sides and in which are disposed bearing means in which a shaft rotates, and the blower wheel apparatus further having a second width between the pair of sides of the blower housing less than the first overall width of the blower wheel apparatus, the blower wheel apparatus comprising, in combination:

rim means, including a first rim and a second rim spaced apart from each other and a plurality of blades secured to and extending between the first and second rims; and spider means, including a first spider secured to the first rim, a first collar secured to the first spider and adapted to be secured to the shaft for rotating the blower wheel apparatus, a second spider secured to the second rim, a second collar secured to the second spider and adapted to be secured to the shaft for rotating the blower wheel apparatus, the overall width of the blower wheel apparatus defined as including the collars, and the first and second spiders are adapted to deflect inwardly to decrease the overall width of the blower wheel apparatus to allow the blower wheel apparatus to be inserted into a blower wheel housing, and adapted to deflect outwardly after insertion into the housing and into the openings of the blower housing and disposed against the bearing means for securing to the shaft for rotating the blower wheel apparatus in the blower housing.

2. The apparatus of claim 1 in which the spider means further includes a plurality of arms secured to the rims.

3. The apparatus of claim 2 in which the collars are secured to the arms of the spider means radially inwardly from the rims.

4. The apparatus of claim 3 in which the first and second collars extend outwardly beyond the first and second rims when secured to the shaft.

5. Blower apparatus, comprising, in combination:

blower housing means, including a first side, a first opening in the first side, a second side spaced apart from the first side, and a second opening in the second side aligned with the first opening;

blower wheel means for insertion into the blower housing means, including, a first rim, a second rim spaced apart from the first rim, a plurality of blades extending between the first and second rims, first spider means extending radially inwardly from the first rim and deflectable inwardly from an undeflected state towards the second rim for insertion into the blower housing and movable outwardly after insertion into the blower housing, a first collar secured to the first spider means and extending outwardly towards the first side of the blower housing means, second spider means extending radially inwardly from the second rim and deflectable inwardly from an undeflected state towards the first rim for insertion in the blower housing and movable outwardly after insertion into the blower housing, and a second collar secured to the second spider means, and extending outwardly therefrom towards the second side of the blower housing means; and a shaft secured to the first and second collars and extending through the first and second openings for rotating the blower wheel means in the blower housing means.

6. The apparatus of cla1m 5 in which the first and second openings in the respective first and second sides of the blower housing means each have a first diameter, and the blower wheel means has a second diameter that is greater than the first diameter of the first and second openings, thus preventing the blower wheel means from being inserted into the blower housing means through the first or second openings.

7. The apparatus of claim 6 in which the blower housing means includes a third opening between the first and second sides for receiving the blower wheel means to insert the blower wheel means into the blower housing means.

8. The apparatus of claim 7 in which the distance between the first side and the second side of the blower housing means defines a first width, and the blower wheel means has an overall width which includes the first and second collars secured to the first and second spiders in their undeflected states and which overall width is greater than the first width of the blower housing, whereby the first and second spiders are deflected inwardly towards their respective opposite rims for decreasing the overall width of the blower wheel means for insertion into the blower housing means and are deflected outwardly after insertion into the blower housing means for securing to the shaft.

9. The apparatus of claim 8 in which the first rim and the second rim are spaced apart a distance defining a second width that is less than the overall width of the blower wheel means and less than the first width of the blower housing means.

10. The apparatus of claim 8 in which the first collar and the second collar are disposed at least partially into the respective first and second openings of the blower housing means sides after insertion of the blower wheel means into the blower wheel housing means and the first and second spiders are deflected outwardly to return to their undeflected states.

11. The apparatus of claim 5 in which the blower housing means further includes a third spider secured to the first side, first bearing means secured to the third spider, a fourth spider secured to the second side, second bearing means secured to the fourth spider, and the shaft extends through the first and second bearing means.

12. The apparatus of claim 11 in which the first and second collars are disposed adjacent to the first and second bearing means, respectively, when secured to the shaft to prevent lateral movement of the blower wheel means in the blower housing means.

13. The apparatus of claim 11 in which first and second spider means are further deflectable outwardly from their undeflected states to be disposed adjacent to the first and second bearing means when secured to the shaft.

14. The method of installing a blower wheel having spider assembly collars into a blower wheel housing having openings through which air flows and having spider assemblies for supporting the blower wheel on a rotating shaft in the openings, and having an air exit opening through which the blower wheel is inserted, and in which the diameter of the blower wheel is greater than the diameter of the openings in the blower wheel housing adjacent to which the blower wheel is to be disposed and in which the width of the blower wheel at the spider assembly is greater than the minimum width of the blower wheel housing, comprising, in combination, the steps of:

providing spider assemblies which flex inwardly to decrease the width of the blower wheel;

flexing the spider assemblies inwardly to decrease the width of the blower wheel;

inserting the blower wheel into the blower wheel housing while the spider assemblies are flexed inwardly; and moving the inwardly flexed spider assemblies outwardly after inserting the blower wheel into the blower housing.

15. The method of claim 14 which further includes the step of inserting a shaft through the housing spider assemblies and the blower wheel spider assemblies.

16. The method of claim 15 which further includes the step of securing the collars of the blower wheel on the shaft and against the spider assemblies of the blower housing.

* * * * *